US005203573A

United States Patent [19]

Brailean

[11] Patent Number: 5,203,573

[45] Date of Patent: Apr. 20, 1993

[54] BALLISTIC ARROW TIP

[75] Inventor: Larry D. Brailean, Regina, Canada

[73] Assignee: Michael M. Sakovich, Ottawa, Canada

[21] Appl. No.: 884,944

[22] Filed: May 18, 1992

[51] Int. Cl.[5] ..... F42B 6/08

[52] U.S. Cl. ..... 273/422; 342/386

[58] Field of Search ..... 273/416, 419–422; 342/386

[56] References Cited

U.S. PATENT DOCUMENTS

| | | | |
|---|---|---|---|
| 2,676,017 | 4/1954 | Selent et al. | 273/421 |
| 4,234,191 | 11/1980 | Erlandson | 273/421 |
| 4,704,612 | 11/1987 | Boy et al. | 342/386 |
| 5,024,447 | 6/1991 | Jude | 342/386 X |
| 5,078,407 | 1/1992 | Carlston et al. | 273/421 |

OTHER PUBLICATIONS

Bow & Arrow Magazine's Bowhunters Annual, No. 16, 1991 Jul. 1991, X-Caliber Advertisement.

Bow & Arrow Hunting, Oct. 1990, Turbo SS Advertisement.

*Primary Examiner*—Paul E. Shapiro
*Attorney, Agent, or Firm*—Michael M. Sakovich

[57] ABSTRACT

An arrowhead for use in a ballistic arrow having a radio locating transmitter comprises a composite structure of a dielectric shank having a plurality of electrically conductive blades that function as a counterpoise for a primary antenna of the transmitter. The blades are disposed symmetrically about a long axis of the shank in respective, uniformly spaced planes that extend radially outwardly from the outer surface of the shank. Another embodiment of the composite arrowhead comprises a unitary dielectric shank and blades wherein the counterpoise is formed by deposition of a thin metal layer on at least a portion of the shank and blade surfaces. The combination of the dielectric shank which is of low density and the electrically conductive counterpoise that is of small mass, effects an overall weight reduction in the arrow to achieve a flatter trajectory and increased flight range.

21 Claims, 1 Drawing Sheet

BALLISTIC ARROW TIP

FIELD OF THE INVENTION

The present invention relates to a ballistic arrow of the type used in hunting small and large game and more particularly to a hunting arrow having radio location means and an antenna element as a weight compensated composite arrowhead to effect a flatter trajectory and increased flight range.

BACKGROUND OF THE INVENTION

A commonly held opinion in the sport of archery is that arrows are the most important part of an archer's equipment. In keeping with this viewpoint, arrows for the serious archer are manufactured to exacting standards and in a range of design parameters to accommodate the physical characteristics of an individual. Since the physical strength of an archer also influences the selection of a bow, which is available in various pulling weights, this too affects arrow performance. The pulling weight represents the force required for a full draw of an arrow of predetermined length for use with the bow and establishes the initial velocity which affects the ballistic characteristics of the arrow. Depending upon the physical strength of the individual, a full draw force may vary from as little as 12 pounds for target shooting over short distances to weights of from 40 to 100 pounds for hunting large game.

A full draw of the arrow is necessary for consistency in shooting over either long or short distances. As a result, it is important to select an arrow of the proper length that would be best suited to the individual. In this regard, the length of the arrow required will vary according to the arm length of the individual which is directly proportionate to height. Arrows are therefore available in various lengths from about 24 inches to 32 inches to accommodate individuals. Both crossbows as well as longbows equipped with an "overdraw" feature allow use of still shorter arrows which are in a range from about 20 inches to 30 inches with corresponding bolts for the crossbows in a range from about 12 to 15 inches. Varying lengths, of course, result in varying arrow weights which affect performance.

Bows used in hunting are generally of heavy pulling weight in order to impart an arrow with higher initial velocity so as to achieve a flatter trajectory and increased flight range. Since shooting ranges commonly vary from point blank to about 200 yards, it is essential that manufacturing tolerances for arrows be strictly maintained in order to provide the hunter with consistency in shooting over long or short distances.

As expected, weight is a critical factor in determining the dynamics of arrow flight and subsequent accuracy of a shot. The weight factor, moreover, presents a serious problem for hunting arrows which are trackable by means of radio signals that emanate therefrom. The principal reason is that a hunting arrow of this type is overweight initially since it includes a radio transmitter and a battery to provide a source of operating voltage, as well as one or more antennas, a combination that is well known in the art. Examples of this type of arrow structure may be readily seen in U.S. Pat. Nos. 4,858,935 Capson, 4,885,800 Raggle, 4,704,612 Boy et al and 5,024,447 Jude, to list but a few instances.

Having regard to the aforedescribed factors that influence performance of an arrow, it is apparent that weight reduction is of particular significance in achieving accuracy and consistency in archery.

SUMMARY OF THE INVENTION

A principal objective of the present invention is the provision of a ballistic arrow having a composite arrowhead fabricated from dissimilar materials.

Another objective of the invention is the provision of a ballistic arrow in which the dissimilar materials of the arrowhead effect an overall weight reduction to achieve a flatter trajectory and increased flight range for the arrow.

Still another objective of the invention is the provision of a trackable ballistic arrow in which the composite arrowhead is an antenna element fabricated from both dielectric and metallic materials and is capable of effectively radiating a radio frequency signal.

The problems associated with the prior art may be substantially overcome and the foregoing provisions achieved by recourse to the invention which is a ballistic arrow with radio locating means comprising, a shaft having a leading end, a body portion adapted to retainably mount a radio frequency transmitter, a fletched trailing end terminated in a nock, a first antenna element operably connectable to the transmitter, and a composite arrowhead adapted to retainably engage the leading end of the shaft, the arrowhead comprising the combination of a dielectric portion of low density and an electrically conductive portion of small mass operably connectable to the transmitter as a second antenna element for effectively radiating a signal therefrom, whereby the combination effects an overall weight reduction to achieve a flatter trajectory and increased flight range for the arrow.

DESCRIPTION OF THE DRAWINGS

The invention will now be more particularly described with reference to embodiments thereof shown, by way of example, in the accompanying drawings in which.

DESCRIPTION OF THE ILLUSTRATED EMBODIMENTS

Figure 1:
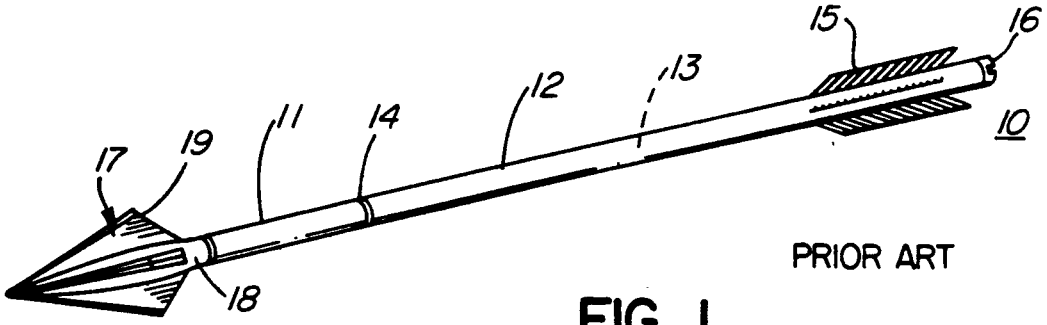
FIG. 1 is a perspective view of a ballistic arrow with radio locating means that is known in the art of archery.

FIG. 1 is illustrative of a ballistic arrow 10 having radio locating means in the form of a radio frequency transmitter module 11 and which is adapted for use as a hunting arrow. The arrow 10 comprises a shaft 12 which is hollow in a body portion 13 thereof that may be adapted to either house a transmitter or to permit attachment of an external transmitter module 11 to a leading end 14 of the body portion 13 as illustrated. It will be observed that the shaft 12 includes a fletched trailing end 15 that is terminated in a nock 16. Although not illustrated in FIG. 1, it will be understood that the arrow 10 embodies both a primary and secondary antenna that are connectable to an output of the transmitter module 11 as is generally known in the prior art and which is particularly illustrated and described in U.S. Pat. No. 5,024,447 Jude.

A conventional arrow tip is shown as an arrowhead 17 in FIG. 1 and is often fabricated with an aluminum shank 18 and steel blades 19, the latter having sufficient hardness to accept and retain a sharp cutting edge. Since the arrowhead 17 is electrically conductive, it also functions as a counterpoise for the module 11 and to this end is electrically isolated from the shaft 12 and is preferably connected to the common ground of a radio transmitter circuit not shown) in the module 11.

Figure 2:
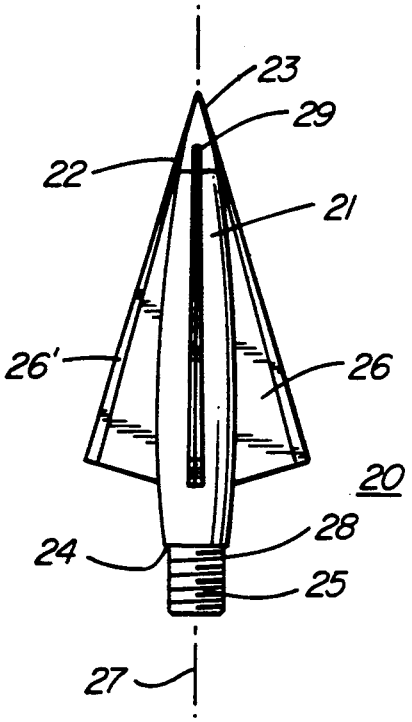
FIG. 2 is a side elevation view of one embodiment of an arrowhead structured in accordance with the present invention.

FIG. 2 illustrates an arrowhead 20 in accordance with the present invention that is directly interchangeable with the arrowhead 17 of FIG. 1, to provide a ballistic arrow with radio locating means that meets all of the objectives of the invention heretofore described.

Departure from the prior art may be readily observed in that the arrowhead 20 is a composite structure which comprises, in combination, a dielectric shank 21 having a leading end 22 to which is fixedly secured a hard metal tip 23 and a trailing end 24 into which is embedded a metal cylindrical insert 28 of small mass having external threads 25 which are adapted to threadedly engage corresponding threads (not shown) in a leading end of the module 11. It will be observed that the diameter of the insert 28 is less than that of the trailing end 24 to permit a smooth and continuous union between the shank 21 and the module 11.

It will be understood from the illustration of FIG. 2 that the arrowhead 20 includes three blades 26 which are disposed symmetrically about a long axis 27 of the arrowhead in respective planes that are radially outstanding from the exterior surface of the shank 21. Typically, an external edge 26' of each blade is sharpened to a sharp cutting edge. In the embodiment of FIG. 2, each blade 26 is fabricated from a metal, such as steel with a high carbon content, which has a sufficient hardness to accept and retain the sharp cutting edge.

Although individual ones of the blades 26 may function as a counterpoise for the primary or secondary antenna (not shown) of the module 11, a greater capacitance between the primary or secondary antenna and earth is obtained when the blades 26 are electrically interconnected. In this way, a relatively lower impedance path to earth is obtained than with just a single blade 26 being used as the counterpoise resulting in improved radiation efficiency.

An electrical connection between all of the blades 26 is achieved by the metal tip 23 which includes notches 29 formed in the tip at the interface between the tip and the leading end of the shank 21. The notches 29 are aligned in registry with corresponding ones of the blades 26, the leading ends of which are secured therein. A dual benefit is achieved in that not only are the blades electrically interconnected by means of the tip 23 to provide a more effective counterpoise, but the notches 29 function as well to assist in securely holding each blade 26 in position on the shank 21, thereby strengthening the overall structure of the arrowhead 20. Additional support for the blades 26 may be provided by including corresponding notches 29 in the embedded end of the insert 28. Moreover, electrical contact of the counterpoise with the common ground side of the transmitter circuit (not shown) in the module 11 may be made via the insert 28.

Although various dielectric materials may be used for the shank 21, a preferred dielectric would have a substantially lower density than the corresponding metals of the prior art. This will effect an overall weight reduction of the arrowhead 20 over that of the conventional arrowhead 17 which is commonly made with an aluminum shank and carbon steel blades. Since the mass of the shank 21 is expected to be substantially greater than that of the blades 26, each of which comprises a thin-walled member, the substitution of a dielectric substance such as plastic for the shank 21 will result in an appreciable weight reduction for an arrow, thereby achieving a flatter trajectory and increased flight range.

Figure 3:
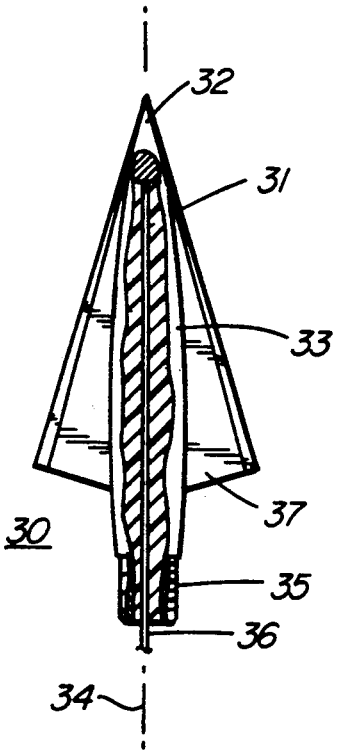
FIG. 3 is a side elevation view of another embodiment of an arrowhead, with a portion removed to show the interior thereof, structured in accordance with the present invention.

Another embodiment of an arrowhead in accordance with the present invention is illustrated in FIG. 3 as an arrowhead 30 having blades 37. The essential difference between the arrowhead 20 as compared to the arrowhead 30 is that in the latter an electrical conductor 31 is connected to a hard metal tip 32 and leads coaxially away therefrom within a shank 33 along a longitudinal axis 34. It will be observed that the conductor 31 extends outwardly of a trailing end 35 of the arrowhead. A trailing free end 36 of the conductor 31 may then be connected to the common ground side of the transmitter circuit (not shown) of the module 11.

The radio frequency wavelength of the transmitted signal from the module 11 is most often much longer than the actual radiating element of the arrow 10, namely the shaft 12 and its acting ground plane or counterpoise formed by the arrowhead 17. This results in an electrical mismatch between the transmitter and antenna with consequent inefficient signal transmission. It is advantageous therefore to electrically lengthen either or both the shaft 12 and the arrowhead 17 to more closely approximate the transmitter's operational wavelength, thereby reducing the mismatch and increasing signal transmission efficiency.

In the arrowhead 30, because the blades 37 make contact with the conductor 31 only at the conductive tip 32 and are elsewhere electrically isolated from the conductor by means of the nonconductive, lightweight plastic shank 33, a certain amount of "shunt" capacitance is formed between the blades 37 and the conductor 31.

The resultant "shunt" capacitance adds to the natural total capacitance/inductance of the blades 37 and conductor 36 combination, thus effectively lowering the resonant frequency of the arrowhead 30 and making its electrical length approximate more closely the operational wavelength of the module 11. This improves radiation efficiency by increasing the overall effective radiation resistance of an arrow's antenna.

Figure 4:
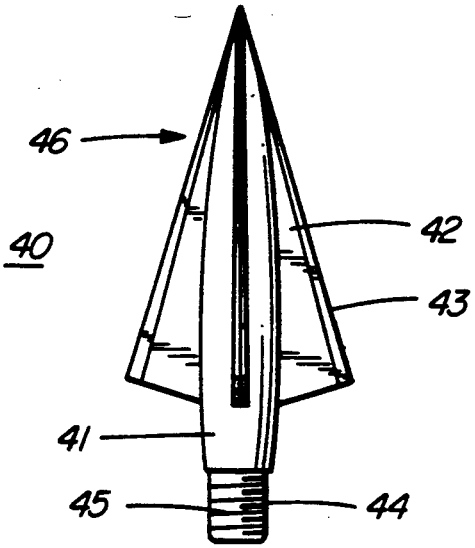
FIG. 4 is a side elevation view of a further embodiment of an arrowhead structured in accordance with the present invention.

FIG. 4 illustrates an arrowhead 40 which embodies the principle of a composite structure as heretofore described, even though the arrowhead per se is formed as an integral structure with a unitary shank 41 and blades 42. The arrowhead 40 is preferably injection molded from suitable plastic that would be known to those skilled in the art of such molding, and is formed with individual ones of the blades 42 having a preformed sharp external edge 43. As well, a trailing end 44 of the shank 41 has threads 45 formed thereon in the molding process.

The composite structure of the arrowhead 40 is achieved by vacuum deposition of a thin metal layer 46 over the exposed dielectric external surfaces of the arrowhead. The metal layer 46 comprises one or more metals selected from a group of metals consisting of chromium, copper, iron nickel, osmium, tantalum, tellurium, titanium, tungsten, vanadium and zirconium or any other metal that may be deposited as a thin layer on the arrowhead 40 and which is sufficiently hard to accept and retain a reasonably sharp cutting edge on individual ones of the blades 42. A separate step of honing such an edge may not be required, however, if the molded sharp edge 43 of each blade 42 is sufficiently thin prior to coating with a retentive, conductive layer of one or more of the aforenoted metals. Since vacuum deposition of metals onto dielectric substrates is well known, a detailed description should not be required to comprehend this aspect of the invention and is accordingly omitted in the interest of brevity.

In view of the metal layer 46 that coats the arrowhead 40, the counterpoise formed thereby would be electrically connected to the common ground side of the transmitter circuit (not shown) in the module 11 via the similarly metal coated threads 45.

It will be apparent to those skilled in the art to whom this specification is addressed that the embodiments heretofore described may be varied to meet particular specialized requirements without departing from the true spirit and scope of the invention disclosed. For example, whereas the surface of the arrowhead 40 has been described as being entirely metallized, such metallization may be restricted to the blades 42 and to a conductive band electrically interconnecting the blades as well as to a conductive portion extending from such band to the threads 45 from which the electrical connection is made to the module 11. In addition to the vacuum deposition method, other known methods of metallization may be used: two examples being electrolytic deposition and metal spraying. Also, it should be understood that fewer or more than three blades may be used depending upon particular arrowhead designs, an example of the former being a blunt, bladeless arrowhead for hunting small game. And although physical changes are not required other than in minor electrical connections, the aforedisclosed arrowheads may be used advantageously as either primary or secondary antennas with the arrow shaft functioning as the counterpoise. Moreover, although the arrowheads illustrated and described herein are adapted for use in an arrow 10 having a radio frequency transmitter, such arrowheads may be used advantageously in a conventional arrow to impart durability and improved ballistic characteristics thereto. The foregoing embodiments are therefore not to be taken as indicative of the limits of the invention but rather as exemplary structures thereof which are described by the claims appended hereto.

The embodiments of the invention in which an exclusive property or privilege is claimed are defined as follows;

1. A ballistic arrow with radio locating means, comprising:

a shaft having a leading end, a body portion adapted to retainably mount a radio frequency transmitter, a fletched trailing end terminated in a nock, and a first antenna element operably connectable to the transmitter; and a composite arrowhead adapted to retainably engage the leading end of the shaft, the arrowhead comprising the combination of a dielectric portion of low density and an electrically conductive coating of small mass deposited on at least a part of the dielectric portion and being operably connectable to the transmitter as a second antenna element for effectively radiating a signal therefrom, whereby the combination imparts durability to the arrowhead and effects an overall weight reduction to achieve a flatter trajectory and increased flight range for the arrow.

2. An arrow as claimed in claim 1, wherein the dielectric portion of the arrowhead comprises a shank having a leading end adapted to strike a target and a trailing end adapted to be connected to the leading end of the shaft.

3. An arrow as claimed in claim 2, further comprising a plurality of blades disposed symmetrically about a long axis of the shank in respective planes radially outstanding from the exterior surface thereof.

4. An arrow as claimed in claim 3, further comprising a hard metal tip disposed in the leading end of the shank.

5. An arrow as claimed in claim 4, wherein the metal tip is notched to supportably engage the leading ends of the blades.

6. An arrow as claimed in claim 5, wherein the blades are thin-walled and of small mass fabricated from metal having sufficient hardness to accept a sharp cutting edge.

7. An arrow as claimed in claim 6, wherein the trailing end of the shank is threaded for screw attachment to corresponding threads disposed on the shaft adjacent the leading end thereof.

8. An arrow as claimed in claim 7, wherein the threaded trailing end of the shank comprises a cylindrical metal insert of small mass.

9. An arrow as claimed in claim 8, wherein the metal insert is notched to supportably engage the trailing ends of the blades.

10. An arrow as claimed in claim 6, wherein the metal tip further comprises an electrical conductor attached thereto which is disposed along the axis and extends exteriorly of the trailing end of the shank for connection to the transmitter, thereby enabling the tip and blades as a second antenna element having predetermined shunt capacitance and a concomitant lowered resonant frequency.

11. An arrow as claimed in claim 1, wherein the dielectric portion comprises:

a shank having a leading end adapted to strike a target and a trailing end adapted to be connected to the leading end of the shaft; and a plurality of blades formed integrally with the shank and disposed symmetrically about a long axis thereof in respective planes radially outstanding from the exterior surface of the shank; and wherein the electrically conductive coating is deposited on at least one of the shank and individual ones of the plurality of blades.

12. An arrow as claimed in claim 11, wherein the conductive coating comprises a thin, retentive layer of metal having sufficient hardness to accept a sharp cutting edge.

13. An arrow as claimed in claim 12, wherein the metal layer comprises at least one metal selected from a group of metals consisting of, chromium, copper, iron, nickel, osmium, tantalum, tellurium, titanium, tungsten, vanadium and zirconium.

14. An arrow as claimed in claim 13, further comprising a hard metal tip disposed in the leading end of the shank.

15. An arrow as claimed in claim 14, wherein the metal tip is notched to supportably engage the leading ends of the blades and further comprises an electrical conductor attached thereto which is disposed along the axis and extends exteriorly of the trailing end of the shank for connection to the transmitter, thereby enabling the tip and blades as a second antenna element having predetermined shunt capacitance and a concomitant lowered resonant frequency.

16. In a ballistic arrow having a shaft with a leading end and a fletched trailing end terminated in a nock, the improvement of a composite arrowhead adapted to be retainably engaged with the leading end, the arrowhead comprising the combination of a dielectric portion of low density and an electrically conductive coating of small mass deposited on at least a part of the dielectric portion which imparts durability to the arrowhead and effects an overall weight reduction to achieve a flatter trajectory and increased flight range for the arrow.

17. A composite arrowhead for a ballistic arrow having a shaft with a leading end and a fletched trailing end terminated in a nock, comprising:

a dielectric shank of low density having a leading end adapted to strike a target and a trailing end adapted to be connected to the leading end of the shaft; and an electrically conductive coating of small mass deposited on at least a portion of the shank for imparting durability to the arrowhead.

18. A composite arrowhead as claimed in claim 17, further comprising a plurality of blades disposed symmetrically about a long axis of the shank in respective planes radially outstanding from the exterior surface of the shank.

19. A composite arrowhead as claimed in claim 18, wherein the blades are formed integrally with the shank and the electrically conductive coating is deposited on at least one of the shank and individual ones of the plurality of blades.

20. An arrowhead as claimed in claim 19, wherein the conductive coating comprises a thin, retentive layer of metal having sufficient hardness to accept a sharp cutting edge.

21. An arrow as claimed in claim 20, wherein the metal layer comprises at least one metal selected from a group of metals consisting of, chromium, copper, iron, nickel, osmium, tantalum, tellurium, titanium, tungsten, vanadium, and zirconium.

* * * * *